US011172552B2

(12) United States Patent
Shin

(10) Patent No.: US 11,172,552 B2
(45) Date of Patent: Nov. 9, 2021

(54) LIGHTING DEVICE

(71) Applicant: AMOSENSE CO.,LTD, Cheonan-si (KR)

(72) Inventor: Gyu Weon Shin, Daejeon (KR)

(73) Assignee: AMOSENSE CO., LTD, Cheonan-si (KR)

( * ) Notice: Subject to any disclaimer, the term of this patent is extended or adjusted under 35 U.S.C. 154(b) by 0 days.

(21) Appl. No.: 16/964,547

(22) PCT Filed: Jan. 8, 2019

(86) PCT No.: PCT/KR2019/000265
§ 371 (c)(1),
(2) Date: Jul. 23, 2020

(87) PCT Pub. No.: WO2019/146933
PCT Pub. Date: Aug. 1, 2019

(65) Prior Publication Data

US 2021/0037623 A1 Feb. 4, 2021

(30) Foreign Application Priority Data

Jan. 24, 2018 (KR) ..... 10-2018-0008825

(51) Int. Cl.
*H05B 45/10* (2020.01)
*F21V 23/00* (2015.01)
(Continued)

(52) U.S. Cl.
CPC ..... *H05B 45/10* (2020.01); *F21V 23/003* (2013.01); *F21V 23/06* (2013.01); *F21V 29/763* (2015.01);
(Continued)

(58) Field of Classification Search
None
See application file for complete search history.

(56) References Cited

U.S. PATENT DOCUMENTS

2009/0290344 A1* 11/2009 Chiang ..... F21S 4/28 362/240
2010/0289428 A1* 11/2010 Frazier ..... H05B 45/00 315/294
(Continued)

FOREIGN PATENT DOCUMENTS

JP 2013-80696 A 5/2013
KR 10-2009-0080196 A 7/2009
(Continued)

OTHER PUBLICATIONS

KR Office Action dated Mar. 2, 2020 as received in Application No. 10-2018-0008825.

*Primary Examiner* — Crystal L Hammond
(74) *Attorney, Agent, or Firm* — Maschoff Brennan

(57) ABSTRACT

Provided is an alternating current direct lighting device capable of a dimming control, the lighting device including: a circuit board having a light emitting diode array; a first connector disposed on the circuit board; a second connector disposed on the circuit board so as to be spaced apart from the first connector; and a driving unit for controlling light emission of the light emitting diode array on the basis of a driving signal input through the first connector and a dimming signal input through the second connector.

11 Claims, 8 Drawing Sheets

(51) Int. Cl.

| | |
|---|---|
| ***F21V 23/06*** | (2006.01) |
| ***F21V 29/76*** | (2015.01) |
| ***F21Y 105/10*** | (2016.01) |
| ***F21Y 115/10*** | (2016.01) |

(52) U.S. Cl.
CPC ..... *F21Y 2105/10* (2016.08); *F21Y 2115/10* (2016.08)

(56) References Cited

U.S. PATENT DOCUMENTS

| | | | | |
|---|---|---|---|---|
| 2010/0301765 | A1* | 12/2010 | Wang | A61P 35/00 315/291 |
| 2011/0193491 | A1* | 8/2011 | Choutov | H05B 45/325 315/291 |
| 2014/0015412 | A1* | 1/2014 | Yang | H05B 47/25 315/85 |
| 2016/0212816 | A1* | 7/2016 | Ackmann | H05B 45/10 |
| 2017/0048944 | A1 | 2/2017 | Kim et al. | |
| 2018/0116021 | A1* | 4/2018 | Jin | H01L 23/49811 |

FOREIGN PATENT DOCUMENTS

| | | | |
|---|---|---|---|
| KR | 10-2017-0019943 | A | 2/2017 |
| KR | 10-1761560 | B1 | 7/2017 |

* cited by examiner

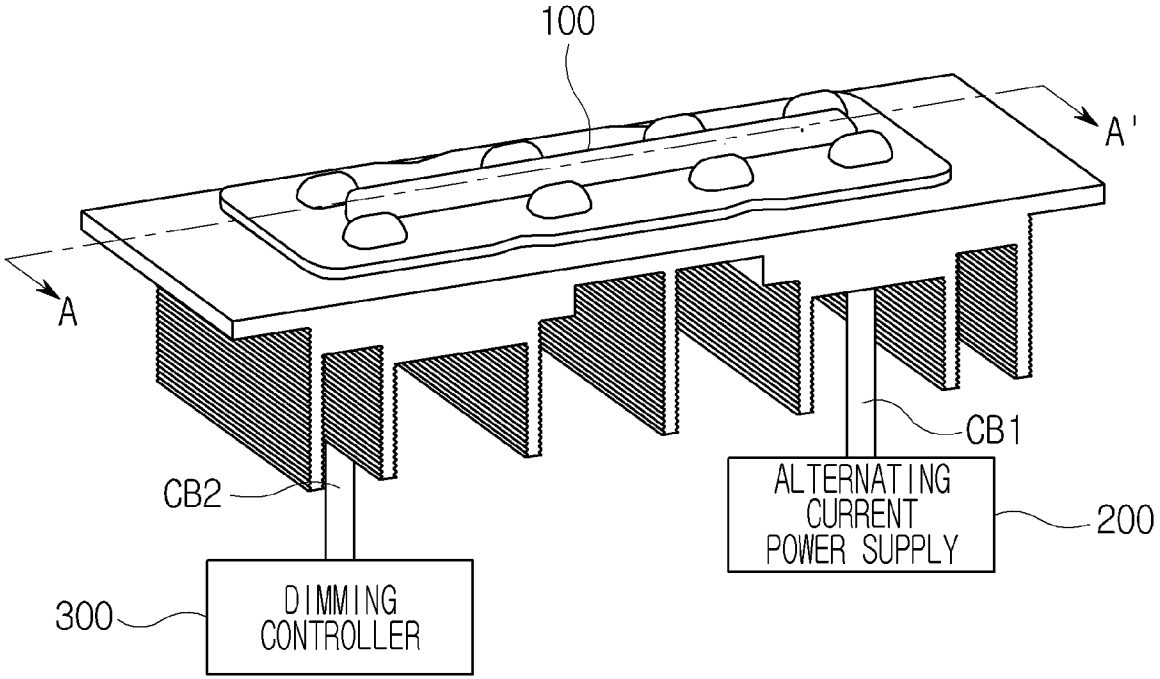
[FIG. 1]

[FIG. 2]
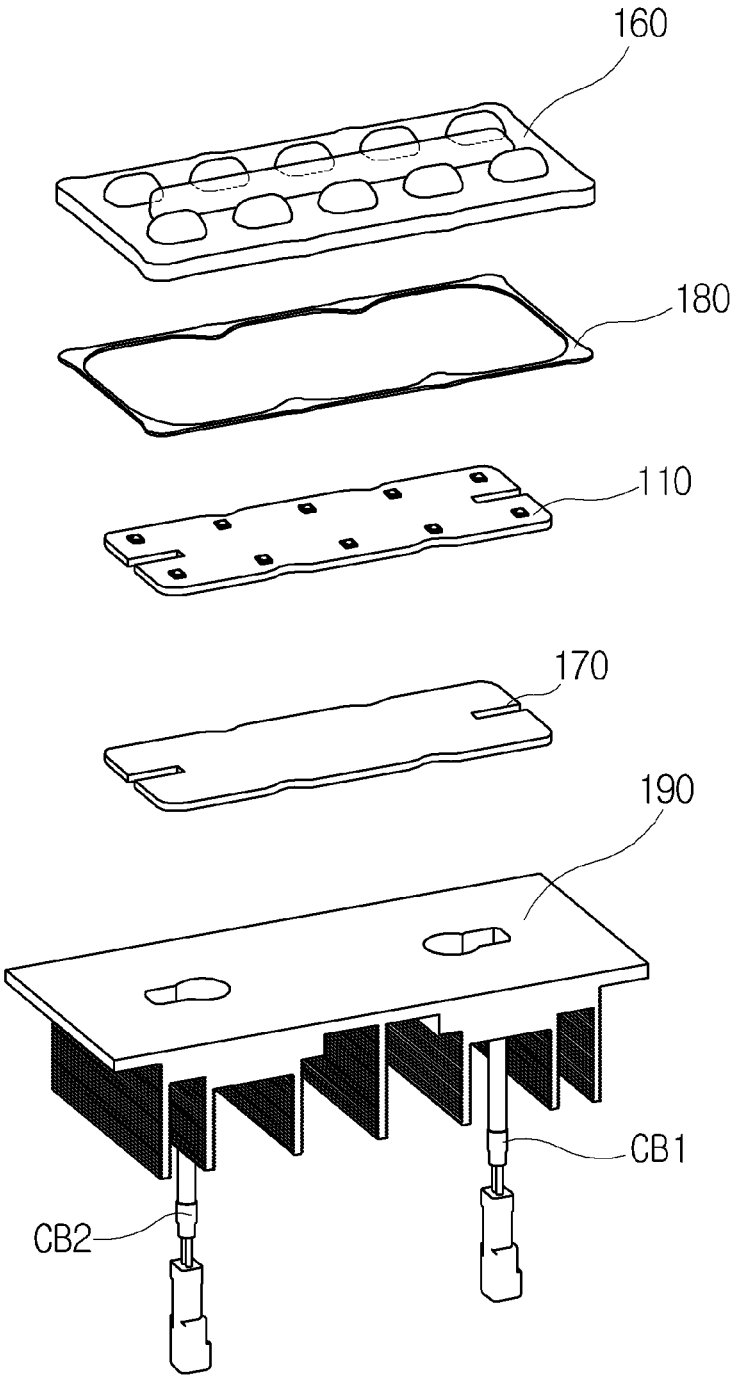

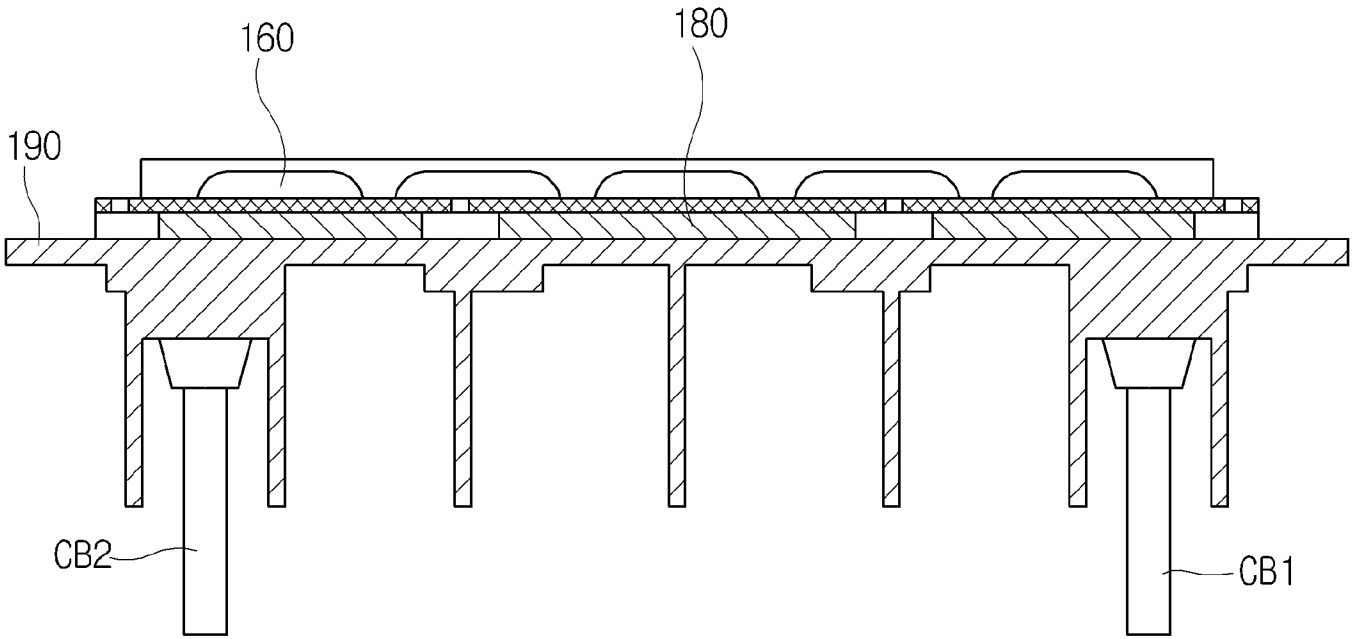
[FIG. 3]

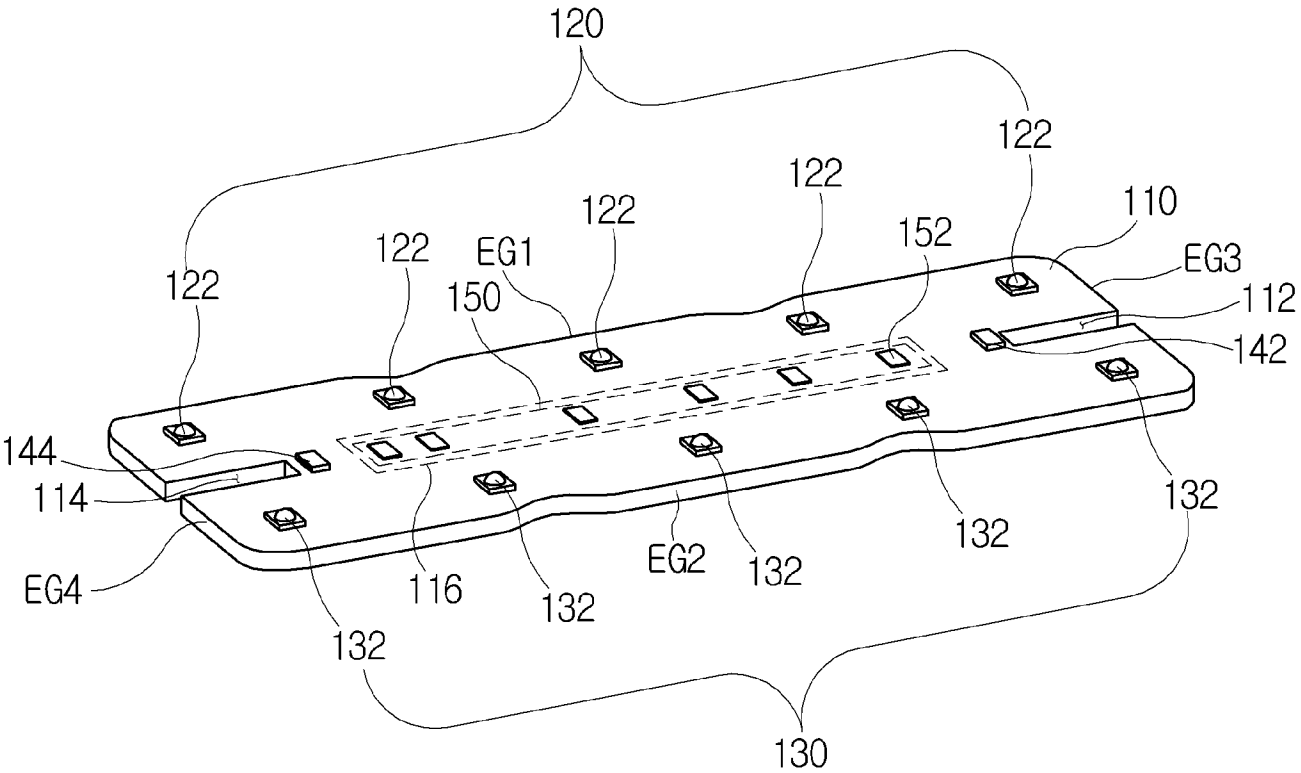
[FIG. 4]

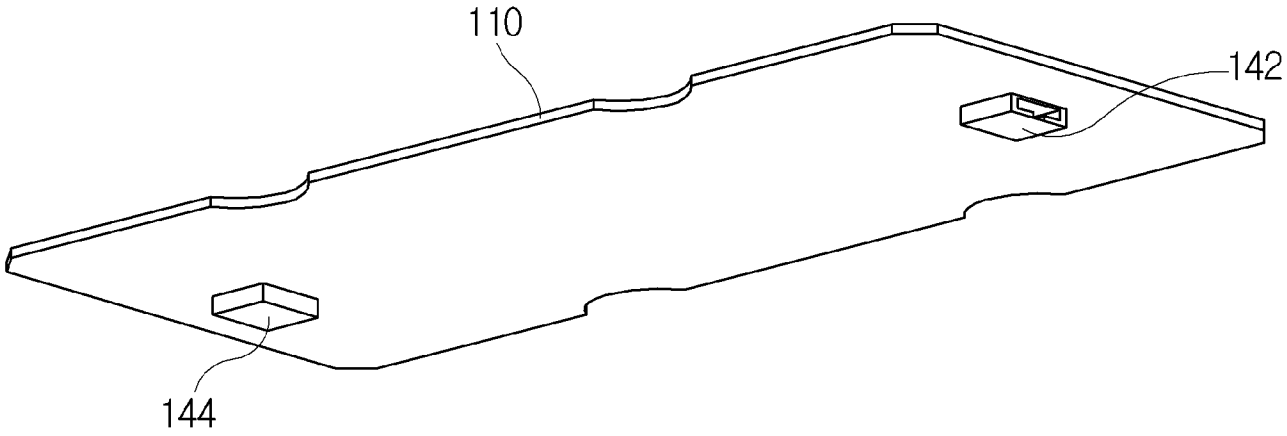
[FIG. 5]

[FIG. 6]
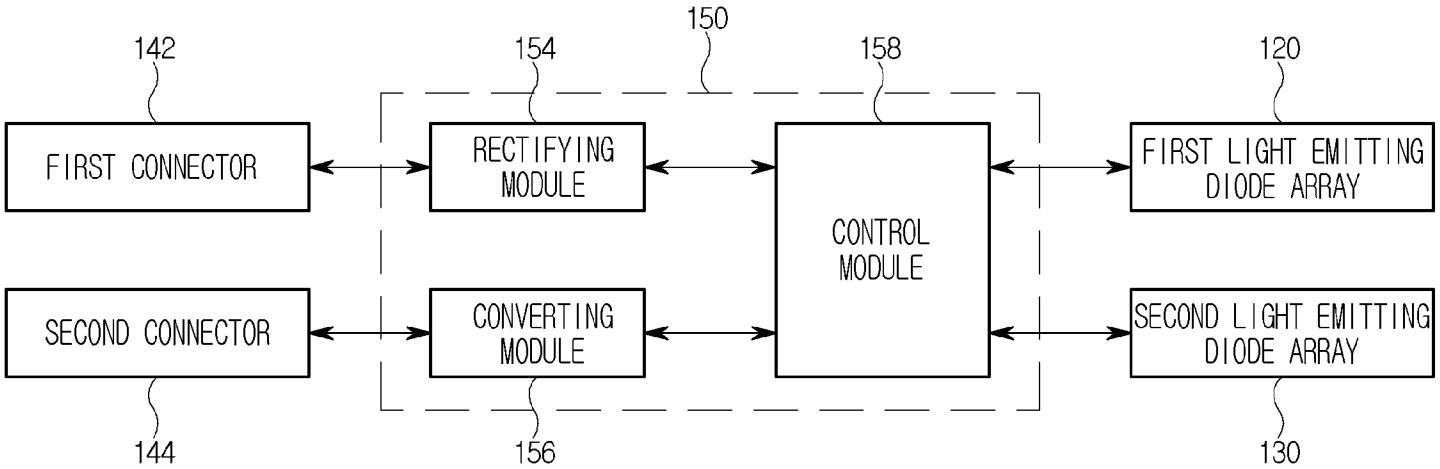

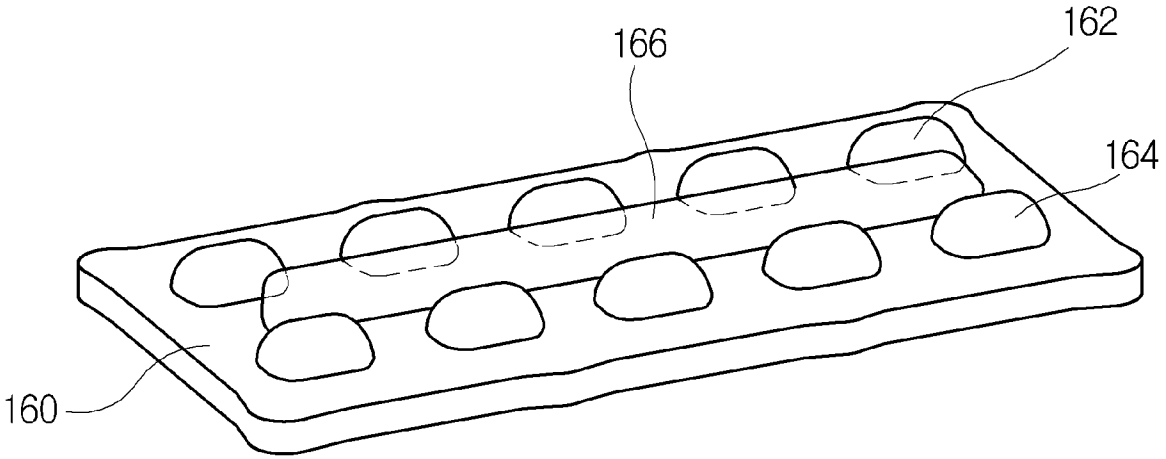
[FIG. 7]

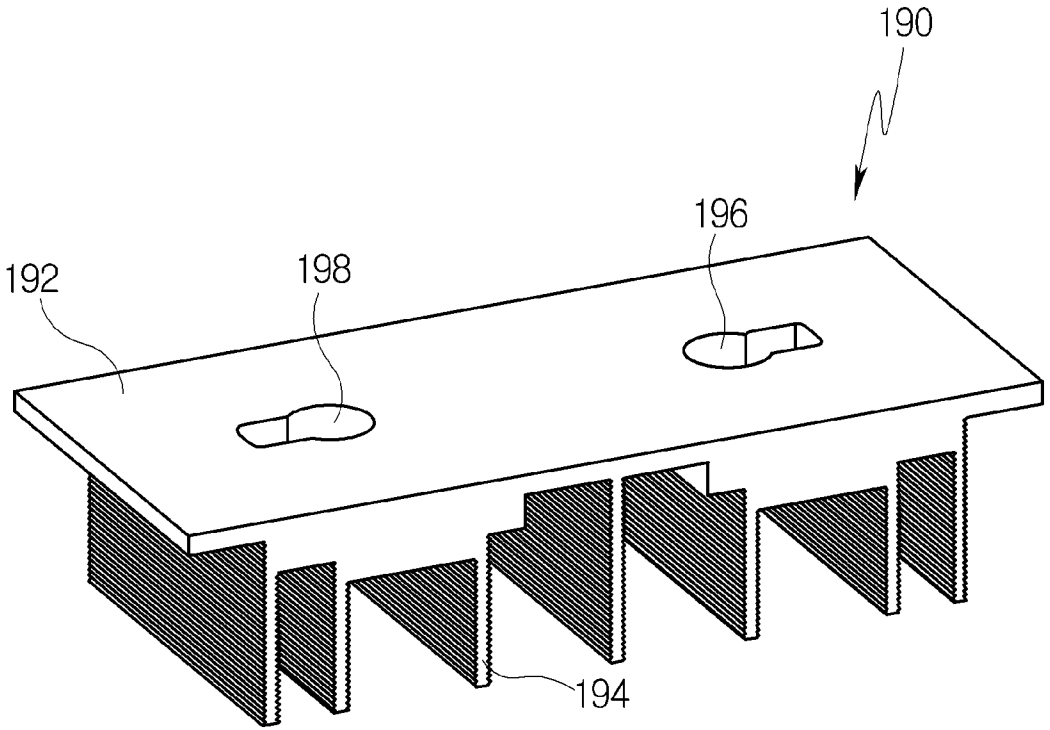
[FIG. 8]

LIGHTING DEVICE

TECHNICAL FIELD

The present disclosure relates to a lighting device, and more particularly, to a lighting device having a light emitting diode as a light source.

BACKGROUND ART

Recently, a light emitting diode has been widely used as a light source for a lighting device. The light emitting diode is an element which converts electrical energy into light energy, and may implement relatively improved luminance at a low power as compared with a light source using a filament.

The lighting device installed on the road is required to maintain a constant brightness (illuminance) at all times within the life span. Accordingly, the lighting device always maintains the constant brightness within the life span through output and dimming controls.

DISCLOSURE

Technical Problem

The present disclosure is proposed to solve the above conventional problem, and an object of the present disclosure is to provide an alternating current direct lighting device capable of a dimming control.

An object of the present disclosure is to provide a lighting device which is configured to form a connector, which is connected to an external dimming controller through a cable, on a circuit board of the lighting device, and to control the brightness of the lighting device according to a dimming signal which is input through the connector.

Technical Solution

For achieving the object, a lighting device according to an exemplary embodiment of the present disclosure includes a circuit board having a light emitting diode array, a first connector which is disposed on the circuit board, a second connector which is disposed on the circuit board so as to be spaced apart from the first connector, and a driving unit which controls light emission of the light emitting diode array based on a driving signal input through the first connector and a dimming signal input through the second connector, in order to provide an alternating current direct lighting device capable of a dimming control.

At this time, the first connector may be disposed adjacently to a first short side of the circuit board and is connected to the first cable which transmits the driving signal, and the second connector may be disposed adjacently to a second short side of the circuit board and is connected to the second cable which transmits the dimming signal. The first connector and the second connector may be disposed on the bottom surface of the circuit board. Here, the driving signal may be an alternating current power source signal, and the dimming signal may be a direct current power source signal.

The driving unit is disposed in a driving unit area of the circuit board. At this time, the driving unit area may be a separation space between a first light emitting diode array and a second light emitting diode array which are disposed on the top surface of the circuit board. Accordingly, the driving unit is disposed between the first light emitting diode array and the second light emitting diode array which are disposed on the top surface of the circuit board.

The driving unit includes a rectifying module which rectifies the driving signal input through the first connector, a converting module which converts a voltage level of the dimming signal input through the second connector, and a control module which controls light emission of the light emitting diode array based on the driving signal rectified by the rectifying module, and controls brightness of the light emitting diode array based on the dimming signal converted by the converting module in order to control the lighting and dimming of the light emitting diode array.

At this time, the rectifying module rectifies the driving signal to output a rectified driving signal which is a direct current power source signal, and the converting module scales the voltage level of the dimming signal to output a converted dimming signal with a voltage level within a reference value. Here, the converting module may scale a dimming signal with a voltage level of 1 V or more and 10 V or less to one having a voltage level of 1 V or more and 1.25 V or less.

The control module may determine that a converted dimming signal with a maximum voltage level is input when the dimming signal is not input to turn on the light emitting diode array at a maximum brightness.

Advantageous Effects

According to the present disclosure, the lighting device may dispose the driving unit between the light emitting diode arrays, thereby preventing the light emitted from the light emitting diodes from interfering with the driving unit in the process of being output to the outside of the lighting device even if the light emitting diodes are mounted on the circuit board together with the driving unit.

Further, the lighting device may dispose the driving unit between the light emitting diode arrays, thereby implementing the maximum irradiation range of the lighting device by minimizing the loss of the original directing angle of each of the light emitting diodes when configuring the lighting device using the light emitting diodes.

Further, the lighting device may dispose the driving unit between the light emitting diode arrays, thereby expanding the irradiation range of the lighting device without increasing the separation distance between the light emitting diode and the driving unit within the circuit board.

Further, the lighting device may dispose the driving unit between the light emitting diode arrays to prevent the light interference by the driving unit, thereby providing the lighting device having an advantageous structure to decrease the size of the lighting device.

Further, the lighting device may perform the dimming control based on the dimming signal which is input through the second connector, thereby performing the dimming control depending upon the event signal for each time zone in the alternating current direct lighting device having no the power supply (SMPS).

Further, the lighting device may perform the dimming control in the alternating current direct lighting device, thereby minimizing unnecessary waste of power, and improving the life span of the product.

DESCRIPTION OF DRAWINGS

FIG. 1 is a perspective diagram of a lighting device according to an exemplary embodiment of the present disclosure.

FIG. 2 is an exploded perspective diagram of the lighting device according to an exemplary embodiment of the present disclosure.

FIG. 3 is a cross-sectional diagram of the lighting device taken along the line A-A' illustrated in FIG. 1.

FIGS. 4 and 5 are diagrams for explaining a first connector and a second connector illustrated in FIG. 1.

FIG. 6 is a diagram for explaining a driving unit illustrated in FIG. 4.

FIG. 7 is a diagram for explaining a lens cover illustrated in FIG. 1.

FIG. 8 is a diagram for explaining a heat sink illustrated in FIG. 1.

MODE FOR INVENTION

Hereinafter, the most preferred exemplary embodiments of the present disclosure will be described with reference to the accompanying drawings in order to specifically describe the exemplary embodiments so that those skilled in the art to which the present disclosure pertains may easily implement the technical spirit of the present disclosure. First, in adding reference numerals to the components of each drawing, it should be noted that the same components have the same reference numerals as much as possible even if they are displayed in different drawings. Further, in describing the present disclosure, when it is determined that the detailed description of the related well-known configuration or function may obscure the gist of the present disclosure, the detailed description thereof will be omitted.

Referring to FIG. 1, a lighting device 100 according to an exemplary embodiment of the present disclosure is connected to an external alternating current power supply through a first cable CB1. The lighting device 100 receives a driving signal from the alternating current power supply through the first cable CB1. At this time, as an example, the driving signal is an alternating current power source as a driving power source for lighting the lighting device 100.

The lighting device 100 is connected to an external dimming controller through a second cable CB2. The lighting device 100 receives a dimming signal from the dimming controller through the second cable CB2. At this time, as an example, the dimming signal is a direct current power source signal for controlling the dimming of the lighting device 100.

Since the lighting device 100, as an alternating current direct lighting device 100 which directly receives an alternating current power source to be turned on, does not include a separate power supply (SMPS), the lighting device 100 receives the dimming signal from the dimming controller through the second cable CB2 to perform a dimming control depending upon an event signal for each time zone.

To this end, referring to FIGS. 2 to 4, the lighting device 100 according to an exemplary embodiment of the present disclosure includes a circuit board 110, a first light emitting diode array 120, a second light emitting diode array 130, a first connector 142, a second connector 144, a driving unit 150, a lens cover 160, a thermal pad 170, a sealing member 180, and a heat sink 190.

The circuit board 110 may be formed of a printed circuit board having a circuit pattern formed on at least one surface of a base board. As an example, the circuit board 110 is a metal printed circuit board. As the metal printed circuit board is made of a metal material, heat generated in the first light emitting diode array 120 and the second light emitting diode array 130 may be easily transferred to the heat sink 190.

The circuit board 110 may be formed in a rectangular shape having a long side and a short side. As an example, the circuit board 110 has a rectangular shape having a first long side EG1, a second long side EG2, a first short side EG3, and a second short side EG4.

At this time, if the first connector 142 is formed on the top surface of the circuit board 110, a first inserting groove 112 into which the first cable CB1 is inserted may be formed in the first short side EG3 of the circuit board 110. If the second connector 144 is formed on the top surface of the circuit board 110, a second inserting groove 114 into which the second cable CB2 is inserted may be formed in the second short side EG4 of the circuit board 110. Here, if the first connector 142 and the second connector 144 are formed on the bottom surface of the circuit board 110, the circuit board 110 may not be formed with the first inserting groove 112 and the second inserting groove 114.

The first light emitting diode array 120 is mounted on the top surface of the circuit board 110. The first light emitting diode array 120 is disposed adjacently to the first long side EG1 of the circuit board 110. The first light emitting diode array 120 is electrically connected to a circuit pattern formed on the circuit board 110. Here, as an example, the top surface of the circuit board 110 is one surface which is disposed in a direction in which the lens cover 160 is mounted.

The first light emitting diode array 120 includes a plurality of first light emitting diodes 122. The plurality of first light emitting diodes 122 are disposed adjacently to the first long side EG1 of the circuit board 110. The plurality of first light emitting diodes 122 are disposed along the first long side EG1, and are spaced apart from each other at a predetermined interval.

The first light emitting diode array 120 generates light in response to a driving signal provided from the outside through the first connector 142. Here, as an example, the driving signal is an alternating current power source signal.

The first light emitting diode array 120 changes the brightness (illuminance) of light in response to a dimming signal provided from the outside through the second connector 144. Here, as an example, the dimming signal is a direct current power source signal.

The second light emitting diode array 130 is mounted on the top surface of the circuit board 110. The second light emitting diode array 130 is disposed adjacently to the second long side EG2 of the circuit board 110. The second light emitting diode array 130 is disposed to be spaced apart from the first light emitting diode array 120. The second light emitting diode array 130 is electrically connected to a circuit pattern formed on the circuit board 110. Here, as an example, the top surface of the circuit board 110 is a surface which is disposed in the direction in which the lens cover 160 is mounted.

The second light emitting diode array 130 includes a plurality of second light emitting diodes 132. The plurality of second light emitting diodes 132 are disposed adjacently to the second long side EG2 of the circuit board 110. The plurality of second light emitting diodes 132 are disposed along the second long side EG2, and are disposed to be spaced apart from each other at a predetermined interval. Here, as an example, the second long side EG2 of the circuit board 110 is opposite to the first long side EG1 of the circuit board 110.

The second light emitting diode array 130 is mounted on the top surface of the circuit board 110. The second light emitting diode array 130 is electrically connected to a circuit pattern formed on the circuit board 110. Here, as an example, the top surface of the circuit board 110 is a surface which is disposed in the direction in which the lens cover 160 is mounted.

The second light emitting diode array 130 generates light in response to the driving signal provided from the outside through the first connector 142. Here, as an example, the driving signal is an alternating current power source signal.

The second light emitting diode array 130 varies the brightness of light in response to the dimming signal provided from the outside through the second connector 144. Here, as an example, the dimming signal is a direct current power source signal.

The first connector 142 is formed on the circuit board 110. The first connector 142 is connected to the first cable CB1 which is inserted through the thermal pad 170 and the heat sink 190 to be described later. The first connector 142 receives the driving signal from the outside through the first cable CB1. Here, as an example, the driving signal is an alternating current power source signal. The first connector 142 is electrically connected to a circuit pattern formed on the circuit board 110. The first connector 142 transmits the input driving signal to the driving unit 150 through the circuit pattern.

The second connector 144 is formed on the circuit board 110. The second connector 144 is connected to the second cable CB2 which is inserted through the thermal pad 170 and the heat sink 190 to be described later. The second connector 144 receives the dimming signal provided from the outside. Here, as an example, the dimming signal is a direct current power source signal. The second connector 144 is electrically connected to the circuit pattern formed on the circuit board 110. The second connector 144 transmits the input dimming signal to the driving unit 150 through the circuit pattern.

Since the second connector 144 receives the dimming signal which is a direct current power source signal, the interference between signals may occur when the second connector 144 is formed adjacently to the first connector 142 which receives the driving signal which is an alternating current power source signal. As an example, the interference between the signals is generation of noise in the dimming signal which is the direct current power source signal by the driving signal which is the alternating current power source signal.

Accordingly, the second connector 144 is formed to be spaced apart from the first connector 142 at a predetermined interval. As an example, referring to FIG. 4, the first connector 142 is formed adjacently to the first short side EG3 of the bottom surface of the circuit board 110, and the second connector 144 is formed adjacently to the second short side EG4 of the bottom surface of the circuit board 110, and thus the first connect 142 and the second connector 144 are spaced apart from each other by the length of the long sides (that is, the first long side EG1 and the second long side EG2) of the circuit board 110.

Referring to FIG. 5, the first connector 142 and the second connector 144 may also be formed on the bottom surface of the circuit board 110. In this case, the first inserting groove 112 and the second inserting groove 114 formed in the circuit board 110 may be omitted.

The driving unit 150 is mounted on the top surface of the circuit board 110 together with the first light emitting diode array 120 and the second light emitting diode array 130. The driving unit 150 is mounted between the first light emitting diode array 120 and the second light emitting diode array 130. The driving unit 150 is disposed in a driving unit area 116 between the first long side EG1 and the second long side EG2 of the circuit board 110. As the first light emitting diode array 120 is disposed adjacently to the first long side EG1 of the circuit board 110, and the second light emitting diode array 130 is disposed adjacently to the second long side EG2, the circuit board 110 is formed with the driving unit area 116 which is a separation space between the first light emitting diode array 120 and the second light emitting diode array 130. The driving unit 150 is mounted in the driving unit area 116, and is disposed between the first light emitting diode array 120 and the second light emitting diode array 130.

The lighting device 100 according to an exemplary embodiment of the present disclosure may dispose the driving unit 150 between the first light emitting diode array 120 and the second light emitting diode array 130, thereby expanding the irradiation range of the light as compared to the conventional lighting device 100 in which the driving unit 150 is disposed between the outer circumference of the circuit board 110 and the light emitting diode array.

The conventional lighting device 100 is required to increase the size of the circuit board 110, and increase the separation distance between the driving unit 150 and the light emitting diode array in order to have the same irradiation range as the lighting device 100 according to an exemplary embodiment of the present disclosure.

On the other hand, the lighting device 100 according to an exemplary embodiment of the present disclosure may expand the light irradiation range even without increasing the size.

The driving unit 150 is electrically connected to the circuit pattern of the circuit board 110. The driving unit 150 is electrically connected to the first connector 142 and the second connector 144 through the circuit pattern. The driving unit 150 controls the light emission of the first light emitting diode array 120 and the second light emitting diode array 130 based on the driving signal transmitted from the first connector 142 and the dimming signal transmitted from the second connector 144. The driving unit 150 generates electrical signals for controlling the light emission of the first light emitting diode array 120 and the second light emitting diode array 130 based on the driving signal and the dimming signal. Here, as an example, the electrical signal is a direct current power source signal. The driving unit 150 may include various electronic elements 152 for generating the electrical signal.

Referring to FIG. 6, the driving unit 150 includes a rectifying module 154, a converting module 156, and a control module 158.

The rectifying module 154 is electrically connected to the first connector 142 through the circuit pattern formed on the circuit board 110. The rectifying module 154 rectifies the driving signal input from the first connector 142. The rectifying module 154 converts the driving signal, which is the alternating current power source signal, into a direct current power source signal. The rectifying module 154 transmits a rectified driving signal, which is the direct current power source signal, to the control module 158.

The converting module 156 is electrically connected to the second connector 144 through the circuit pattern formed on the circuit board 110. The converting module 156 converts the voltage level of the dimming signal input from the second connector 144.

The dimming controller outputs, as a dimming signal, a direct current power source signal having a voltage level in the range of about 1 V to 10 V defined by Korea Expressway Corporation. The circuits operating in the lighting device 100 have an allowable direct current power source of 1.25

V or less, such that when the dimming signal is directly applied to the control module 158, damage to the circuit occurs, or the voltage level is not recognized, and thus it is impossible to perform the dimming control.

Accordingly, the converting module 156 converts the dimming signal to one having a voltage level of 1.25 V or less. The converting module 156 transmits the converted dimming signal with the converted voltage level to the control module 158.

The control module 158 controls the light emission of the first light emitting diode array 120 and the second light emitting diode array 130 based on the rectified driving signal. The control module 158 supplies the rectified driving signal transmitted from the rectifying module 154 to the first light emitting diode array 120 and the second light emitting diode array 130 to turn on the first light emitting diode 122 and the second light emitting diode 132.

The control module 158 controls the brightness of the first light emitting diode array 120 and the second light emitting diode array 130 based on the converted dimming signal. The control module 158 controls the brightness of the first light emitting diode array 120 and the second light emitting diode array 130 by modulating the pulse width of the rectified driving signal based on the converted dimming signal.

The control module 158 stores a lookup table which is associated with the voltage level and pulse width modulation information. The control module 158 detects the pulse width modulation information corresponding to the voltage level of the converted dimming signal from the lookup table. The control module 158 varies the pulse width of the rectified driving signal applied to the first light emitting diode array 120 and the second light emitting diode array 130 based on the detected pulse width modulation information.

At this time, if the dimming signal is not input, the control module 158 controls the first light emitting diode 122 and the second light emitting diode 132 to be turned on at the maximum brightness. If the dimming signal is not input, the control module 158 determines that the dimming signal with the maximum voltage level is input to control the first light emitting diode 122 and the second light emitting diode 132 to be turned on at the maximum brightness.

The lens cover 160 is made of a material having a light transmitting property. As an example, the material of the lens cover 160 contains at least one of plastics such as poly methyl methacrylate (PMMA) and polycarbonate (PC), glass, and silicon.

The lens cover 160 covers the first light emitting diode array 120 and the second light emitting diode array 130. The lens cover 160 adjusts a progressing direction of the light emitted from the plurality of first light emitting diodes 122 and the plurality of second light emitting diodes 132.

Referring to FIG. 7, the lens cover 160 includes a plurality of first optical lenses 162, a plurality of second optical lenses 164, and a cover part 166.

The first optical lens 162 covers the first light emitting diode 122 to have a one-to-one correspondence with the first light emitting diode 122. The first optical lens 162 may have a convex lens shape. The first optical lens 162 may spread the light emitted from the first light emitting diode 122 to expand the irradiation range of the lighting device 100.

The second optical lens 164 covers the second light emitting diode 132 to have a one-to-one correspondence with the second light emitting diode 132. The second optical lens 164 may have a convex lens shape. The second optical lens 164 may spread the light emitted from the second light emitting diode 132 to expand the irradiation range of the lighting device 100.

The cover part 166 covers the driving unit 150 mounted on the circuit board 110. The cover part 166 is formed to have some areas of the lens cover 160 corresponding to the driving location convexly protrude.

The cover part 166 may be formed integrally with the first optical lens 162 and the second optical lens 164. The lens cover 160 may be formed in a plate shape substantially having the size and shape corresponding to the circuit board 110 to cover the circuit board 110.

Accordingly, the lens cover 160 adjusts the progressing direction of the light emitted from the first light emitting diode array 120 and the second light emitting diode array 130, and at the same time, protects the circuit board 110 and the driving unit 150 (that is, the electronic elements 152 mounted on the circuit board 110) from moisture, dust, and shock.

The thermal pad 170 is interposed between the circuit board 110 and the heat sink 190. The thermal pad 170 may be made of a metal such as aluminum or copper. The thermal pad 170 may also be made of a resin such as polycarbonate or epoxy. The thermal pad 170 transfers the heat generated from the circuit board 110 and the driving unit 150 to the heat sink 190.

The sealing member 180 is disposed at the rim side of the lens cover 160, and is disposed on the contact surface between the lens cover 160 and the heat sink 190. As an example, an O-ring is used as the sealing member 180. The sealing member 180 blocks moisture, foreign substance, or the like from being introduced into the lens cover 160 through a gap between the lens cover 160 and the heat sink 190 in a state where the lens cover 160 and the heat sink 190 are coupled to each other.

The heat sink 190 is disposed on the bottom surface of the circuit board 110. The heat sink 190 directly or indirectly contacts the circuit board 110 to support the circuit board 110. The heat sink 190 may be made of a metal, such as aluminum or copper. The heat sink 190 discharges the heat generated from the circuit board 110 and the driving unit 150 to the outside.

Referring to FIG. 8, the heat sink 190 includes a heat-dissipating plate 192 and a plurality of heat-dissipating fins 194.

The heat-dissipating plate 192 is disposed on the bottom surface of the circuit board 110 to support the circuit board 110. The heat-dissipating plate 192 is formed with a first connector hole 196 and a second connector hole 198 which penetrate the heat-dissipating plate 192.

The first connector hole 196 is formed at a location which corresponds to the first connector 142 formed on the bottom surface of the circuit board 110. The first cable CB1 electrically connected to the first connector 142 penetrates the first connector hole 196 to be taken out of the lighting device 100. The first cable CB1 is electrically connected to a power supply outside the lighting device 100 to transmit a driving signal to the driving unit 150.

The second connector hole 198 is formed at a location which corresponds to the second connector 144 formed on the bottom surface of the circuit board 110. The second cable CB2 electrically connected to the second connector 144 penetrates the second connector hole 198 to be taken out of the lighting device 100. The second cable CB2 is electrically connected to a dimming controller outside the lighting device 100 to transmit a dimming signal to the driving unit 150.

The plurality of heat-dissipating fins 194 are disposed to be spaced apart from each other. The plurality of heat-dissipating fins 194 are formed separately from the heat-dissipating plate 192 to be coupled to the bottom surface of the heat-dissipating plate 192. The plurality of heat-dissipating fins 194 may also be formed integrally with the heat-dissipating plate 192, and may be formed to extend outward from the bottom surface of the heat-dissipating plate 192.

The heat sink 190 has a wide surface area in contact with the atmosphere through a structure including the heat-dissipating plate 192 and the plurality of heat-dissipating fins 194, such that the heat generated from the circuit board 110 and the driving unit 150 may be easily discharged to the outside.

In the aforementioned embodiment, the lighting device 100 has been described as including all of the thermal pad 170, the sealing member 180, and the heat sink 190, but is not limited thereto. As an example, the thermal pad 170 or the sealing member 180 may be omitted from the lighting device 100. The lighting device 100 may also include the heat sink 190 having a structure of the heat-dissipating plate 192 having no heat-dissipating fin 194.

Although the preferred exemplary embodiment of the present disclosure has been described above, it is understood that the present disclosure may be modified in various forms, and those skilled in the art may carry out various modified examples and changed examples without departing from the scope of the claims of the present disclosure.

The invention claimed is:

1. A lighting device comprising:

a circuit board having a light emitting diode array;

a first connector which is disposed on the circuit board;

a second connector which is disposed spaced apart from the first connector on the circuit board; and a driving unit which controls light emission of the light emitting diode array based on a driving signal input through the first connector and a dimming signal input through the second connector, wherein the driving unit comprises:

a rectifying module which rectifies the driving signal input through the first connector;

a converting module which converts a voltage level of the dimming signal input through the second connector; and a control module which controls light emission of the light emitting diode array based on the driving signal rectified by the rectifying module, and controls brightness of the light emitting diode array based on the dimming signal converted by the converting module, wherein the converting module lowers the voltage level of the dimming signal to output a converted dimming signal with a voltage level within a reference value.

2. The lighting device of claim 1, wherein the light emitting diode array is disposed on the top surface of the circuit board, and comprises:

a first light emitting diode array having a plurality of first light emitting diodes which are disposed adjacently to a first long side of the circuit board along the first long side; and a second light emitting diode array having a plurality of second light emitting diodes which are disposed adjacently to a second long side of the circuit board along the second long side.

3. The lighting device of claim 1, wherein the first connector is disposed adjacently to a first short side of the circuit board and is connected to the first cable which transmits the driving signal, and wherein the second connector is disposed adjacently to a second short side of the circuit board and is connected to the second cable which transmits the dimming signal.

4. The lighting device of claim 1, wherein the first connector and the second connector are disposed on the bottom surface of the circuit board.

5. The lighting device of claim 1, wherein the driving signal is an alternating current power source signal, and the dimming signal is a direct current power source signal.

6. The lighting device of claim 1, wherein the driving unit is disposed in a driving unit area of the circuit board, and wherein the driving unit area is a separation space between a first light emitting diode array and a second light emitting diode array which are disposed on the top surface of the circuit board.

7. The lighting device of claim 1, wherein the driving unit is disposed between the first light emitting diode array and the second light emitting diode array which are disposed on the top surface of the circuit board.

8. The lighting device of claim 1, wherein the rectifying module rectifies the driving signal to output a rectified driving signal which is a direct current power source signal.

9. The lighting device of claim 1, wherein the converting module scales a dimming signal with a voltage level of 1 V or more and 10 V or less to one having a voltage level of 1 V or more and 1.25 V or less.

10. The lighting device of claim 1, wherein the control module determines that a converted dimming signal with a maximum voltage level is input when the dimming signal is not input.

11. The lighting device of claim 1, wherein the control module turns on the light emitting diode array at a maximum brightness when the dimming signal is not input.

* * * * *